US008734642B2

(12) United States Patent
Fauchet

(10) Patent No.: US 8,734,642 B2
(45) Date of Patent: May 27, 2014

(54) OIL FILTERING AND DISTRIBUTING DEVICE FOR SUPPLYING TWO OIL PUMPS OF AN AIRCRAFT ENGINE

(75) Inventor: Christian Fauchet, Boussy Saint Antoine (FR)

(73) Assignee: Societe de Motorisations Aeronautiques, Bourges (FR)

( * ) Notice: Subject to any disclaimer, the term of this patent is extended or adjusted under 35 U.S.C. 154(b) by 399 days.

(21) Appl. No.: 13/271,895

(22) Filed: Oct. 12, 2011

(65) Prior Publication Data

US 2012/0085689 A1 Apr. 12, 2012

(30) Foreign Application Priority Data

Oct. 12, 2010 (FR) ..... 10 58297

(51) Int. Cl.
*F16N 39/06* (2006.01)
*C02F 1/00* (2006.01)

(52) U.S. Cl.
USPC ..... 210/167.04; 210/167.02; 210/805; 210/167.08; 210/167.31

(58) Field of Classification Search
CPC ..... F16N 2039/06; F16N 2270/48; F16N 2270/60; F16N 2280/04; F01M 1/10; F01M 1/16; F01M 11/02; F01M 11/03; F01M 2001/16
USPC ..... 210/805, 167.02, 167.08, 167.04, 210/167.31
See application file for complete search history.

(56) References Cited

U.S. PATENT DOCUMENTS 4,296,716 A * 10/1981 Hofbauer et al. ..... 123/195 C

* cited by examiner

*Primary Examiner* — Krishnan S Menon
*Assistant Examiner* — Allison Gionta Fitzsimmons
(74) *Attorney, Agent, or Firm* — Pillsbury Winthrop Shaw Pittman LLP

(57) ABSTRACT

An oil filtering and distributing device for supplying a first oil pump and a second oil pump of an aircraft engine, the pumps sucking up oil in a common housing, the device including a casing with a lower part and an upper part; a first sleeve coupling for supplying the first pump; a second sleeve coupling for supplying the second pump; the casing including a first compartment receiving oil via a first screen and supplying the first pump with oil via the first sleeve coupling, a second compartment receiving oil via a second screen and supplying the second pump with oil via the second sleeve coupling, an isolator arranged between the first compartment and the second compartment.

10 Claims, 2 Drawing Sheets

OIL FILTERING AND DISTRIBUTING DEVICE FOR SUPPLYING TWO OIL PUMPS OF AN AIRCRAFT ENGINE

CROSS-REFERENCE TO RELATED APPLICATIONS

This application claims the benefit of priority from French Patent Application No. 1058297 filed on Oct. 12, 2010, the entire content of which is incorporated herein by reference.

FIELD

The present invention relates to an oil filtering and distributing device for supplying two oil pumps of an aircraft engine. The technical field of the invention is that of aircraft engines, and more specifically that of oil pumps used for example to lubricate and cool specific parts of the engine.

The subject matter of the present invention is an oil filtering and distributing device for an association of two oil pumps sucking up oil in the same housing. This device is particularly adapted for an association of two pumps operating at different flow rates. The invention also relates to an engine comprising such a device.

BACKGROUND

Traditionally, an engine oil pump sucks up oil stored in an oil housing through a strainer and sends it to a circuit, for example an engine lubricating circuit. The oil housing also cooperates with recycling means making it possible to recover excess oil and transfer it again to the oil housing so as to again be sucked up by the oil pump. The strainer thus fulfils the role of an oil filter; it filters the impurities of the oil so as to stop them from penetrating the oil pump. The strainer is immersed in the oil housing.

Some engines, such as the SMA SR305-230 engine, are equipped with an association of two pumps sucking up oil in the same housing. Each pump cooperates with a circuit, for example in the case of the SMA SR305-230 engine, a lubricating circuit and a cooling circuit. Traditionally, the oil returns via a screen to the strainer of the housing, where it is sucked up by the two pumps.

FIG. 1 shows an exploded view of an oil filtering and distributing device 1 for an association of two pumps according to the prior art. The device 1 comprises a casing 12 formed of a lower part 10 and an upper part 11. The lower part 10 comprises an aperture in which a circular screen 13 is installed. The upper part 11 comprises a first aperture 14 and a second aperture 15 in which a first sleeve coupling 16 and a second sleeve coupling 17 are fitted. The first sleeve coupling 16 and the second sleeve coupling 17 are connected to the two pumps. The oil penetrates the housing 12 via the screen 13. It is sucked up there by the two pumps.

Such a device has proven to be satisfactory if the two pumps operate at the same flow rate. Otherwise, the pump having the stronger flow rate interferes with the pump having the weaker flow rate by starving the pump having the weaker flow rate. The oil pump having a weaker flow rate is thus deprimed, possibly resulting in destruction of the engine. Such a problem is currently encountered in some engines in which the flow rate of the pump associated with the lubricating circuit and the pump associated with the cooling circuit have to be operated at different flow rates.

SUMMARY

An aspect of the invention provides a solution to the problem just described by proposing a device, as a result of which the pump having the stronger flow rate does not interfere with the pump having the weaker flow rate.

In order to do this, an aspect of the present invention proposes modifying the structure of the strainer by dividing it into two compartments by a tight partition. Each compartment has a screen via which the oil penetrates. Each pump is then connected to a compartment in which it sucks up the oil necessary for its operation. Beneficially, the size of each screen is calculated in such a way that it is adapted to the flow rate at which the pump associated with it operates The suction flows of the two pumps therefore do not interfere with one another.

An embodiment of the invention therefore basically relates to an oil filtering and distributing device for supplying a first oil pump and a second oil pump of an aircraft engine, said pumps sucking up oil in a common housing, wherein the device comprises:

- a casing with a lower part and an upper part
- a first sleeve coupling for supplying the first pump
- a second sleeve coupling for supplying the second pump, the casing comprising:
  - a first compartment receiving oil via a first screen and supplying the first pump with oil via the first sleeve coupling
  - a second compartment receiving oil via a second screen and supplying the second pump with oil via the second sleeve coupling
  - an isolation means or isolator arranged between the first compartment and the second compartment.

In addition to the main features which have just been described in the paragraph above, the device according to an embodiment of the invention may have one or more supplementary features from the following list, considered in isolation or in any technically feasible combination:

- the first pump cooperates with a cooling circuit, and the second pump cooperates with a lubricating circuit of the engine
- the first screen is disposed on the upper part of the casing and the second screen is disposed on the lower part of the casing
- the isolation means or isolator is a tight partition, in particular a stainless steel partition
- the first screen and the second screen have the same central axis, which is perpendicular to the planes containing the first screen and the second screen
- the first screen is associated with the cooling circuit and the second screen is associated with the lubricating circuit
- the flow rate of the first pump is between 60 L/min and 80 L/min, and the flow rate of the second pump is between 40 L/min and 60 L/min
- the diameter of the first screen is between 69.5 mm and 70.5 mm and the diameter of the second screen is between 64.5 mm and 65.5 mm
- the upper part of the casing supports a cover on which the first screen is installed
- the cover conceals an aperture formed in the upper part of the casing in the first compartment.

Another aspect of the invention relates to an engine comprising the oil filtering and distributing device according to the invention.

Embodiments of the invention and its different applications will be better understood on reading the following description and studying the accompanying figures.

BRIEF DESCRIPTION OF THE FIGURES

The figures are only given by way of example and in no way limit the invention. In the figures.

DETAILED DESCRIPTION

Unless stated otherwise, an identical element appearing in different figures has only one reference sign.

Figure 1:
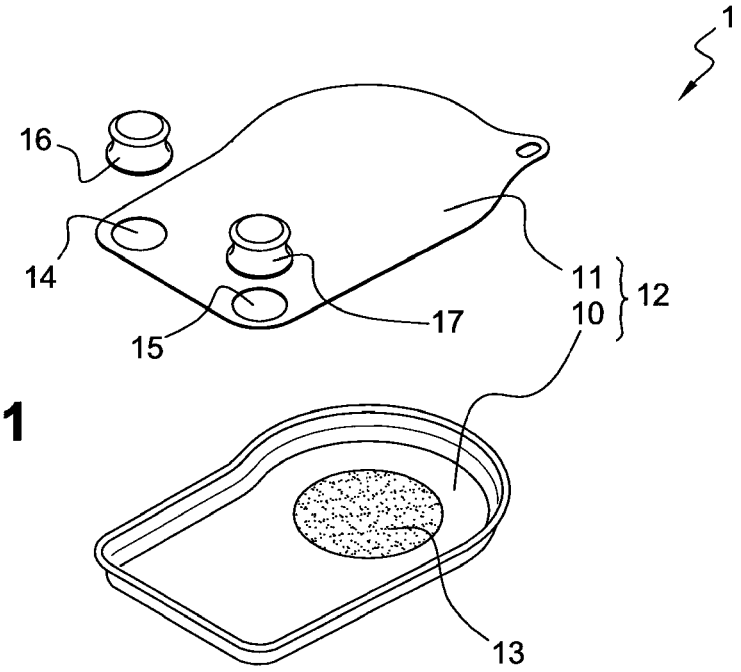
FIG. 1, which has already been described, is an exploded view of an oil filtering and distributing device according to the prior art.
Figure 2:
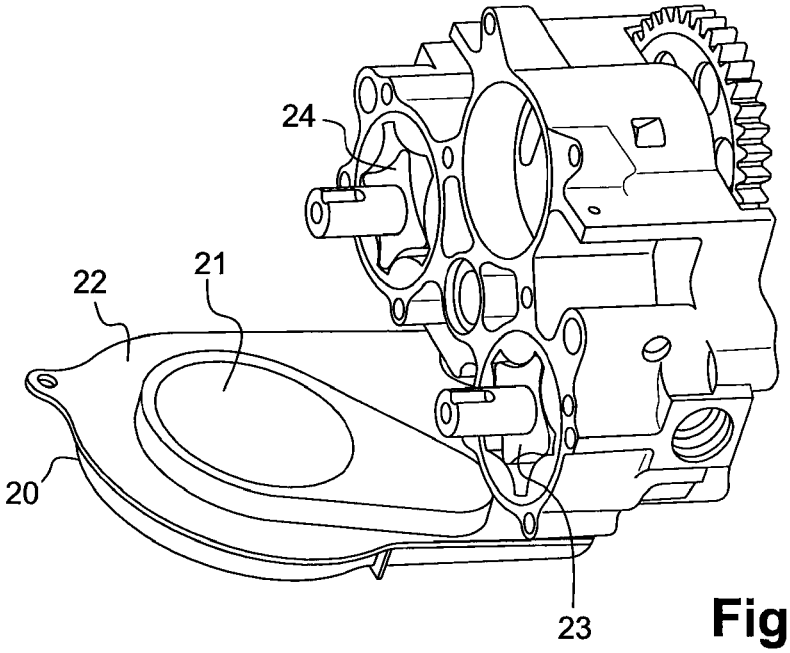
FIG. 2 is a perspective view of a device according to one embodiment of the invention, connected to an association of two oil pumps.
Figure 3:
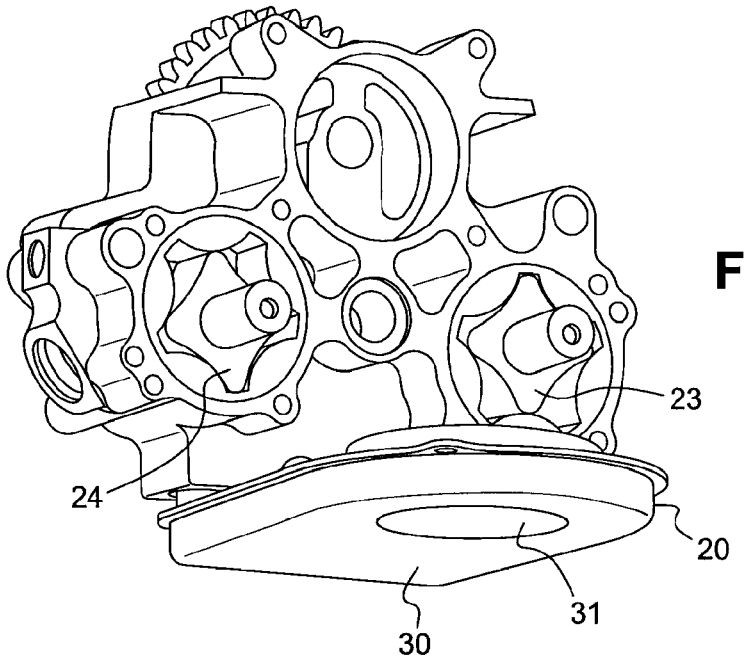
FIG. 3 is another perspective view of the elements of FIG. 2.

FIGS. 2 and 3 respectively show a first and a second perspective view of a device 20 according to one embodiment of the invention, connected to an association of a first oil pump 23 and a second oil pump 24. FIG. 2 shows the device 20 in plan view. It can thus be seen that a first screen 21 is installed on an upper part 22 of the device. FIG. 3 shows the device 20 from beneath. It can be seen that a second screen 31 is installed on a lower part 30 of the device.

Figure 4:
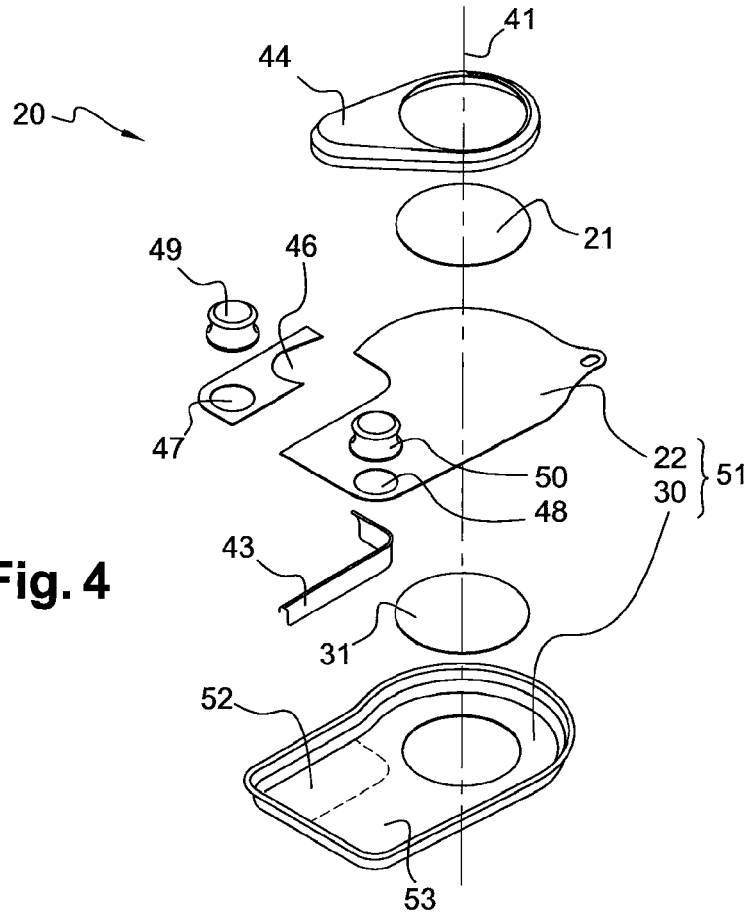
FIG. 4 is an exploded view of the device of FIG. 2.

FIG. 4 shows an exploded view of the device 20. This device comprises a casing 51 formed of a lower part 30 and an upper part 22. The upper part 22 comprises a first aperture 47 and a second aperture 48. A first sleeve coupling 49 is fitted in the first aperture 47, and a second sleeve coupling 50 is fitted in the second aperture 48. The first sleeve coupling 49 is connected to the first pump 23, and the second sleeve coupling 50 is connected to the second pump 24. The lower part 30 of the casing 51 comprises an aperture, in which a screen 31 is fitted.

In the embodiment of FIG. 4, an isolator formed by an L-shaped partition 43 separates the casing 51 into a first compartment 52 and a second compartment 53. The partition 43 is tight and beneficially made of stainless steel. It is beneficially welded both on the upper part 22 and on the lower part 30. The partition 43 is installed in such a way that the oil circulating through the screen 31 discharges completely into the compartment 53. The upper part 22 of the casing 51 is pierced by an aperture 46. The aperture 46 is positioned to the side of the compartment 52. A cover 44 is fixed above the upper part 22 of the casing 51. The cover 44 has an aperture in which a first screen 21 is installed. Beneficially, the first screen 21 and the second screen 31 have the same central axis 41, which is perpendicular to the planes containing the first screen 21 and the second screen 31, which makes it possible to delay as far as possible an occurrence of depriming of the casing 51. The cover 44 conceals the aperture 46. As a result of this arrangement, the oil circulating through the first screen 21 discharges completely into the first compartment 52.

In a second embodiment of the invention, the screen 21 is installed directly on the upper part 22 of the casing 51, above the first compartment 52. In a third embodiment of the invention, the screen 21 is installed on the lower part 30 of the casing 51, to the side of the first compartment 52. Nevertheless, the benefit of the described embodiment is as follows: by placing the second screen 31 below the first screen 21, the depriming is less likely to occur in the second compartment 53 than in the first compartment 53.

The device 20 is in an oil housing, immersed in oil. Oil thus penetrates the first compartment 52 via the first screen 21, and the second compartment 53 via the second screen 31. In the first compartment 52, the oil is sucked up by the first oil pump 23 via the first sleeve coupling 49. In the second compartment 53, the oil is sucked up by the second oil pump 24 via the second sleeve coupling 50. The suction flows of the first oil pump 23 and of the second oil pump 24 are thus independent; the pumps do not interfere with one another.

In the event of depriming, it is more important to protect a lubricating circuit of an aircraft engine than a cooling circuit. In fact, overheating of the engine can be corrected manually by the pilot of the aircraft, whereas poor lubrication may lead to destruction of the engine. The first oil pump 23 is thus beneficially connected to an engine cooling circuit, and the second oil pump 24 is connected to an engine lubricating circuit. In fact, as a result of such an allocation, in the event of depriming the oil still penetrates the second compartment 53 and is sucked up by the second oil pump 24, since the second screen 31 allowing entry of the oil into the second compartment 53 is positioned on the lower part 30 of the casing 51.

Beneficially, the diameters of the first screen 21 and of the second screen 31 are dimensioned in a manner adapted to the supply of the first oil pump 23 and the supply of the second oil pump 24. In fact, the diameters of the screens impact the angles of depriming: the smaller the diameters of the screens, the more the angle of depriming increases. The device according to an embodiment of the invention just described in the example illustrated thus makes it possible to propose a twin suction strainer which makes it possible to lubricate the engine with a volume of oil reduced by half in relation to the actual capacity of the oil housing while permitting angles of pitch between −18° and +22°.

What is claimed is:

1. An oil filter and distributing device for supplying "oil" to a first oil pump and a second oil pump of an aircraft engine, said pumps sucking up oil in a common housing, the device comprising:

a casing with a lower part and an upper part;

a first sleeve coupling configured to supply the first pump;

a second sleeve coupling configured to supply the second pump, the casing comprising:

a first compartment configured to receive oil via a first screen and to supply the first pump with oil via the first sleeve coupling, a second compartment configured to receive oil via a second screen and to supply the second pump with oil via the second sleeve coupling, and an isolator arranged between the first compartment and the second compartment said isolator being a tight partition that prevents oil flow between the first compartment and the second compartment.

2. The device according to claim 1, wherein the first pump is configured to cooperate with an engine cooling circuit and the second pump is configured to cooperate with an engine lubricating circuit.

3. The device according to claim 1, wherein the first screen is disposed on the upper part of the casing and the second screen is disposed on the lower part of the casing.

4. The device according to claim 1, wherein the first screen and the second screen have the same central axis, which is substantially perpendicular to the planes containing the first screen and the second screen.

5. The device according to claim 1, wherein the first pump is configured to cooperate with an engine cooling circuit and the second pump is configured to cooperate with an engine lubricating circuit, and wherein the first screen is associated with the cooling circuit, and wherein the second screen is associated with the lubricating circuit.

6. The device according to claim 1, wherein a flow rate of the first pump is between 60 L/min and 80 L/min and a flow rate of the second pump is between 40 L/min and 60 L/min.

7. The device according to claim 1, wherein a diameter of the first screen is between 69.5 mm and 70.5 mm and a diameter of the second screen is between 64.5 mm and 65.5 mm.

8. The device according to claim 1, wherein the upper part of the casing supports a cover on which the first screen is installed.

9. The device according to claim 8, wherein the cover (44) conceals an aperture formed in the upper part of the casing in the first compartment.

10. An aircraft engine, comprising the device according to claim 1.

* * * * *